US007713093B2

(12) United States Patent
Kim

(10) Patent No.: US 7,713,093 B2
(45) Date of Patent: May 11, 2010

(54) CONNECTING MODULE FOR MOBILE COMMUNICATION TERMINAL

(75) Inventor: Jung-Hoon Kim, Seoul (KR)

(73) Assignee: Tyco Electronics AMP Korea Ltd., Kyungsangbuk-Do (KR)

( * ) Notice: Subject to any disclaimer, the term of this patent is extended or adjusted under 35 U.S.C. 154(b) by 0 days.

(21) Appl. No.: 12/132,821

(22) Filed: Jun. 4, 2008

(65) Prior Publication Data

US 2008/0299831 A1 Dec. 4, 2008

(30) Foreign Application Priority Data

Jun. 4, 2007 (KR) ..... 10-2007-0054532

(51) Int. Cl.
*H01R 24/00* (2006.01)

(52) U.S. Cl. ..... 439/660

(58) Field of Classification Search ..... 439/660, 439/680, 676, 609, 607
See application file for complete search history.

(56) References Cited

U.S. PATENT DOCUMENTS 6,843,683 B2 * 1/2005 Cheng ..... 439/606
2002/0048993 A1 * 4/2002 Chen et al. ..... 439/607
2006/0134983 A1 * 6/2006 Wang et al. ..... 439/607
2006/0286865 A1 * 12/2006 Chou et al. ..... 439/607

FOREIGN PATENT DOCUMENTS

JP 2005-310715 11/2005
JP 2006-172768 6/2006

* cited by examiner

*Primary Examiner*—Alexander Gilman
(74) *Attorney, Agent, or Firm*—Barley Snyder LLC

(57) ABSTRACT

A connecting module for a mobile communication terminal includes a housing, a first connecting terminal member, and a second connecting terminal member. The first connecting terminal member is provided in an upper region of the housing for electrically connecting to connecting terminals of a universal serial bus memory. The second connecting terminal member is provided in a lower region of the housing for electrically connecting to an input/output device. The second connecting terminal member has a different length than the first connecting terminal member.

11 Claims, 7 Drawing Sheets

CONNECTING MODULE FOR MOBILE COMMUNICATION TERMINAL

CROSS-REFERENCE TO RELATED APPLICATIONS

This application claims the benefit of the filing date under 35 U.S.C. § 119(a)-(d) of Korea Patent Application No. 10-2007-0054532, filed Jun. 4, 2007.

FIELD OF THE INVENTION

The present invention relates to a connecting module for use in a mobile communication terminal, and more particularly, to a connecting module for a mobile communication terminal, wherein a universal serial bus (USB) memory or an input/output device, connected to a mobile communication terminal for use, can be selectively connected to a single connecting module provided in the mobile communication terminal, rather than requiring different exclusive connecting modules.

BACKGROUND

Initial mobile communication terminals were used for simple conversation purposes only. However, at the current state of technical development, a variety of content is accessible with a mobile communication terminal, allowing the mobile communication terminal to serve a variety of purposes. For example, in addition to a simple conversation function, each day mobile communication terminals are adapted to new functions, such as for example, as personal information storage medium enabling credit card payments, and as a moving picture experts group layer—3 Audio (MP3) player, camera, game machine, mobile image storage medium, and a video telephone.

The above-described mobile communication terminal must include multiple connecting ports, and various shapes of connecting modules corresponding to the connecting ports, in consideration of the above described various additional functions. Of the multiple connecting modules, in particular, to allow the mobile communication terminal to be used with a USB memory, or an input/output device used to interface a signal from an earphone, remote controller, TV, etc., which has recently grown in popularity and is occasionally connected to the mobile communication terminal for use, mobile communication terminals have recently been provided with connecting modules corresponding to the USB memory and the input/output device.

However, in the housing of the conventional mobile communication terminal, it must have both a USB memory connecting module and an input/output device connecting module, thereby limiting miniaturization of the mobile communication terminal, conflicting with the trend towards ever leaner and smaller mobile communication terminals. Consequently, this restriction in the installation space of the connecting modules makes it impossible to achieve fabrication of a smaller and leaner mobile communication terminal.

SUMMARY

It is an object of the present invention to provide a connecting module for a mobile communication terminal, wherein a USB memory or an input/output device, connected to the mobile communication terminal for use, can be selectively connected to a single connecting module provided in the mobile communication terminal, rather than requiring different exclusive connecting modules.

This and other objects are achieved by a connecting module for a mobile communication terminal comprising a housing, a first connecting terminal member, and a second connecting terminal member. The first connecting terminal member is provided in an upper region of the housing for electrically connecting to connecting terminals of a universal serial bus memory. The second connecting terminal member is provided in a lower region of the housing for electrically connecting to an input/output device. The second connecting terminal member has a different length than the first connecting terminal member.

DETAILED DESCRIPTION OF THE EMBODIMENT(S)

Figure 1:
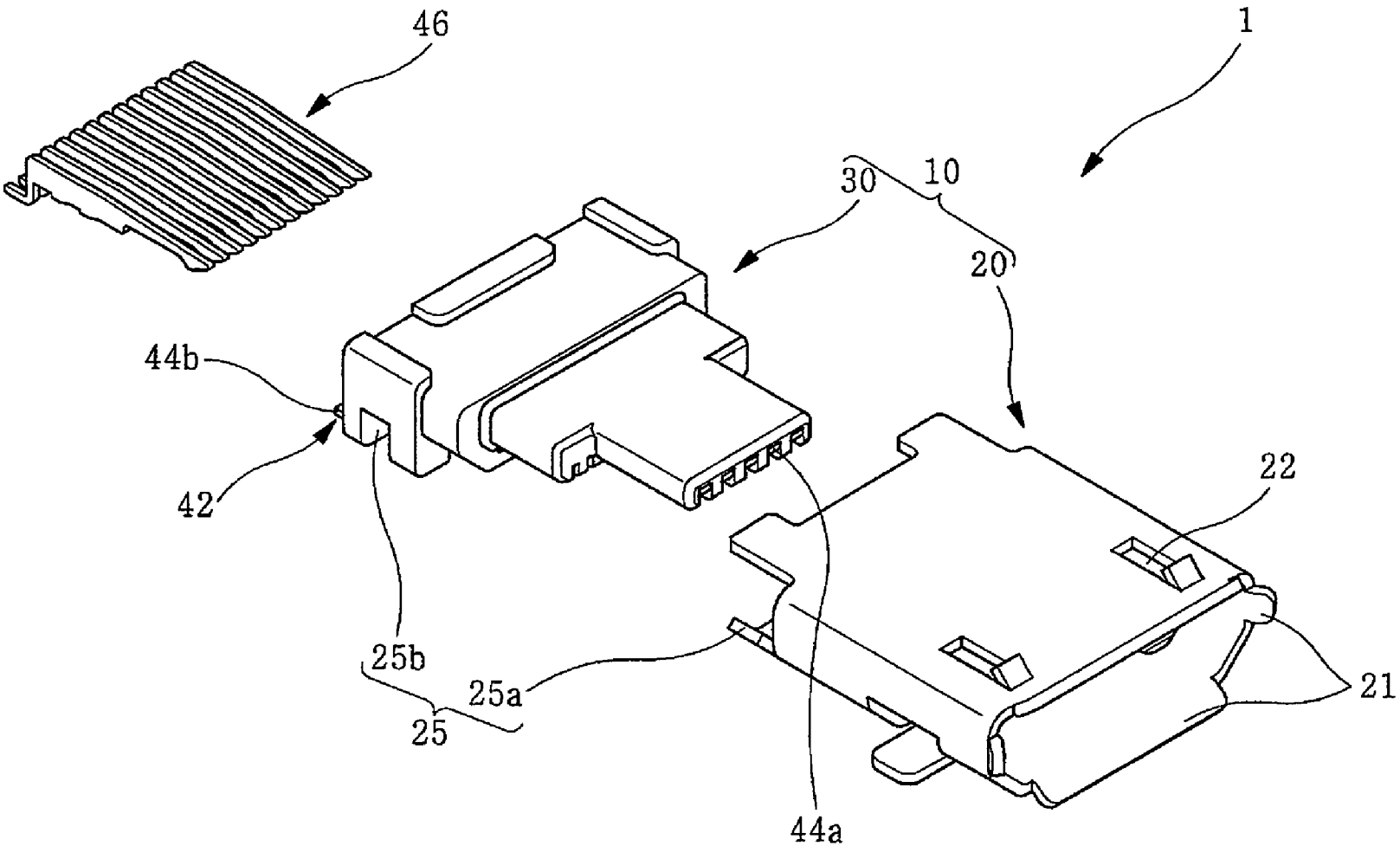
FIG. 1 is an exploded perspective view of a connecting module for a mobile communication terminal according to the present invention.

Now, a preferred embodiment of the present invention will be described in more detail with reference to the accompanying drawings. As shown in FIG. 1, the present invention provides a connecting module 1 for use in a mobile communication terminal, which is provided to connect a USB memory 100 (FIGS. 4*a*-4*b*), or an input/output device 200 (FIGS. 5*a*-5*b*) used to interface a signal from an earphone, remote controller, TV, etc., to the mobile communication terminal. In the present invention, a USB port or the input/output device 200, connected to the mobile communication terminal for use, can be selectively connected to a single connecting module 1 provided in the mobile communication terminal, rather than requiring different exclusive connecting modules.

As shown in FIG. 1, the connecting module 1 includes a housing 10 consisting of a guide housing 20 and a connecting terminal housing 30. The guide housing 20 includes an entrance/exit opening for insertion of the USB memory 100 or the input/output device 200. An outer periphery of the entrance/exit opening has an outwardly-spread guiding piece 21 to facilitate easy insertion of the USB memory 100 or the input/output device 200 into the guide housing 20. The guide housing 20 is formed at positions nearby one end thereof with retaining openings 22 to retain bosses formed at the USB memory 100 or the input/output device 200 when the USB memory 100 or the input/output device 200 is inserted into the housing 10.

The connecting terminal housing 30 is fixedly coupled with the guide housing 20 by a fixing structure 25 as it is inserted into the guide housing 20 from the other end of the guide housing 20. The fixing structure 25 includes a fixing piece 25*a* formed at the guide housing 20, and a fixing recess 25*b* formed at the connecting terminal housing 30 at a position corresponding to the fixing piece 25*a*. When the connecting terminal housing 30 is inserted into and fixed in the guide housing 20, the fixing piece 25*a* and the fixing recess 25*b* of the fixing structure 25 can be firmly coupled with and fixed to each other.

Figure 2:
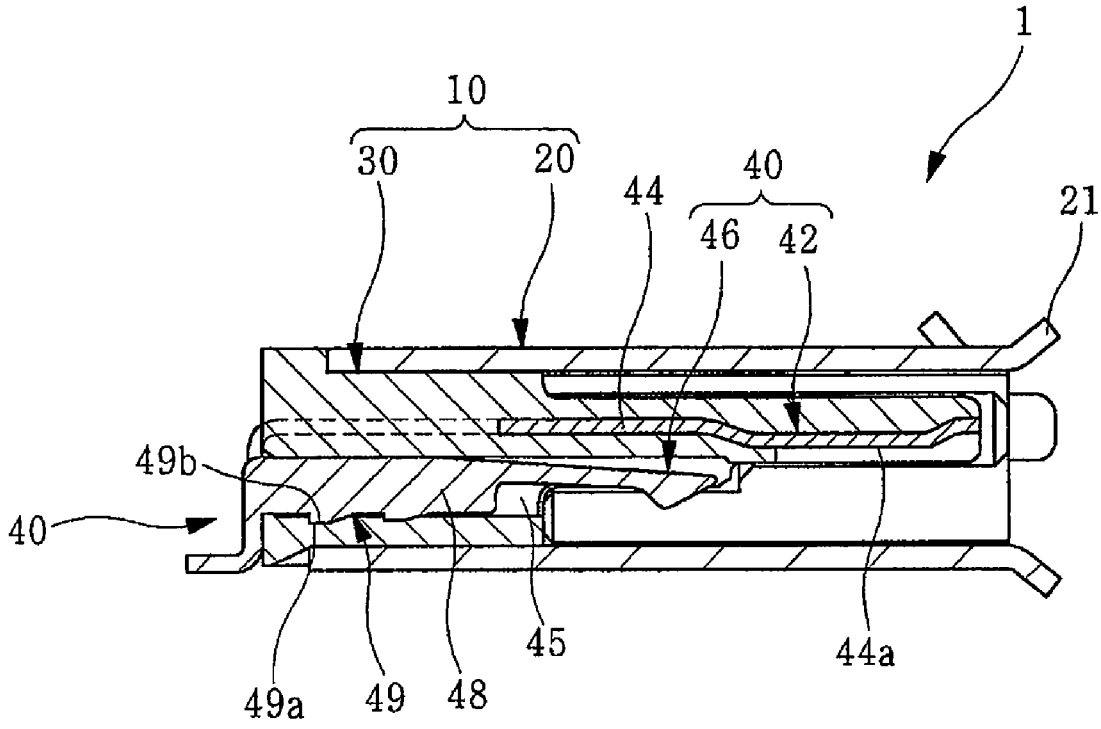
FIG. 2 is a side sectional view of the connecting module in FIG. 1 in an assembled state.
Figure 3:
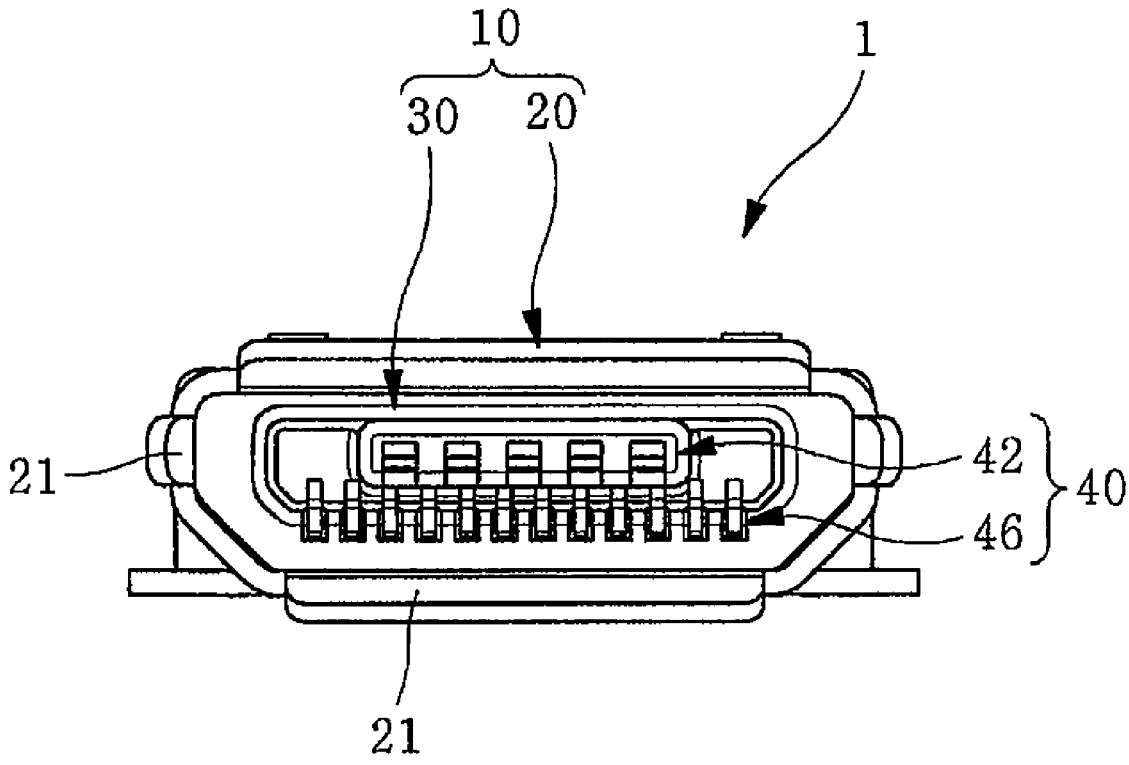
FIG. 3 is a schematic front view of FIG. 2.

As shown in FIG. 2, a plurality of connecting terminal members 40 is received in the housing 10. The connecting terminal members 40 are located at different heights in the housing 10 and have different lengths, such that each of them is connected with only the connecting terminals 102 of the USB memory 100 (FIGS. 4*a*-4*b*) or connecting terminals 102 of the input/output device 200 (FIGS. 4*a*-4*b*) when the USB memory 100 or the input/output device 200 is inserted into the housing 10. The connecting terminal members 40 include a first connecting terminal member 42 for connection with the connecting terminals 102 of the USB memory 100 and the second connecting terminal member 46 for connection with the connecting terminals 102 of the input/output device 200. The first connecting terminal member 42 is incorporated in the connecting terminal housing 30 by a general insert injection method upon fabrication of the connecting terminal housing 30. The second connecting terminal member 46 is inserted and fixed in the connecting terminal housing 30 such that it is located below the first connecting terminal member 42.

The first connecting terminal member 42 is located in an upper region of the connecting terminal housing 30 and includes a plurality of USB memory connecting terminals 44, which are inserted rearward from a front side of the first connecting terminal member 42. Preferably, each of the USB memory connecting terminals 44 consists of a connecting portion 44*a* formed at a front end thereof and a coupling portion 44*b* formed at a rear end thereof. The connecting portion 44*a* has an open bottom surface to be connected with a corresponding connecting terminal 202 of the USB memory 100. The coupling portion 44*b* is spread out laterally away from the connecting portion 44*a* so as to protrude rearward from either lateral side of the connecting terminal housing 30. The coupling portion 44*b* is used for connection of a controller provided in the mobile communication terminal.

The second connecting terminal member 46 includes a plurality of input/output device connecting terminals 48, which are configured to be fixedly inserted into a plurality of insertion openings 45 formed in the connecting terminal housing 30 below the first connecting terminal member 42. Each of the input/output device connecting terminals 48 is firmly retained in the insertion opening 45 by a retaining structure 49. Preferably, each of the input/output device connecting terminals 48 is shorter than each of the USB memory connecting terminals 44 such that a front end of the input/output device connecting terminals 48 is spaced apart rearward from a front end of the USB memory connecting terminals 44, so as to be connected only with the connecting terminal 202 of the input/output device 200. In the housing 10, rear ends of the input/output device connecting terminal 48 and the USB memory connecting terminal 44 are located on the same line as each other, for coupling with the controller of the mobile communication terminal.

The retaining structure 49 preferably includes at least one retaining protrusion 49*a* formed at the input/output device connecting terminal 48 and a retaining recess 49*b* formed at a bottom surface of the insertion opening 45 at a position corresponding to the retaining protrusion 49*a*. In the housing 10, more preferably, the retaining protrusion 49*a* includes a plurality of the retaining protrusions 49*a*, which are inclined in an insertion direction to assure smooth insertion of the input/output device connecting terminal 48.

Figure 4A:
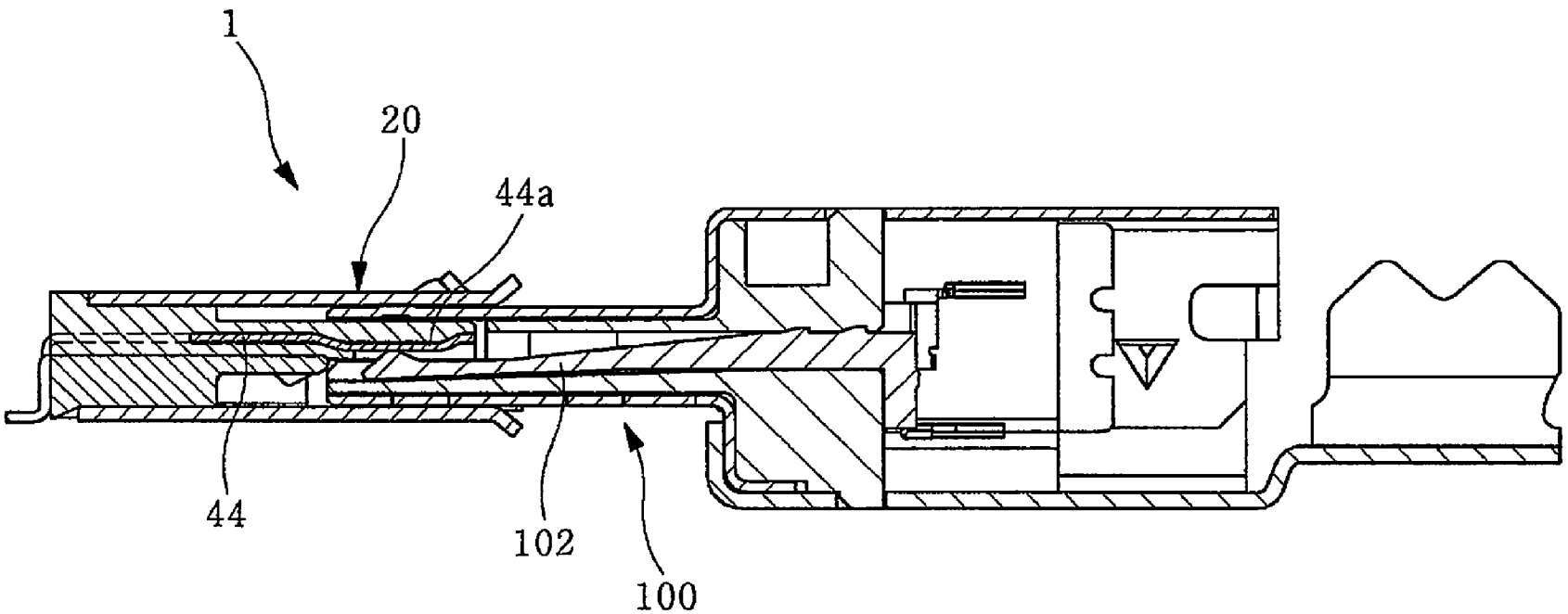
FIG. 4*a* is a side sectional view of the connecting module in FIG. 1 showing a state wherein a USB memory is coupled to the connecting module.
Figure 4B:
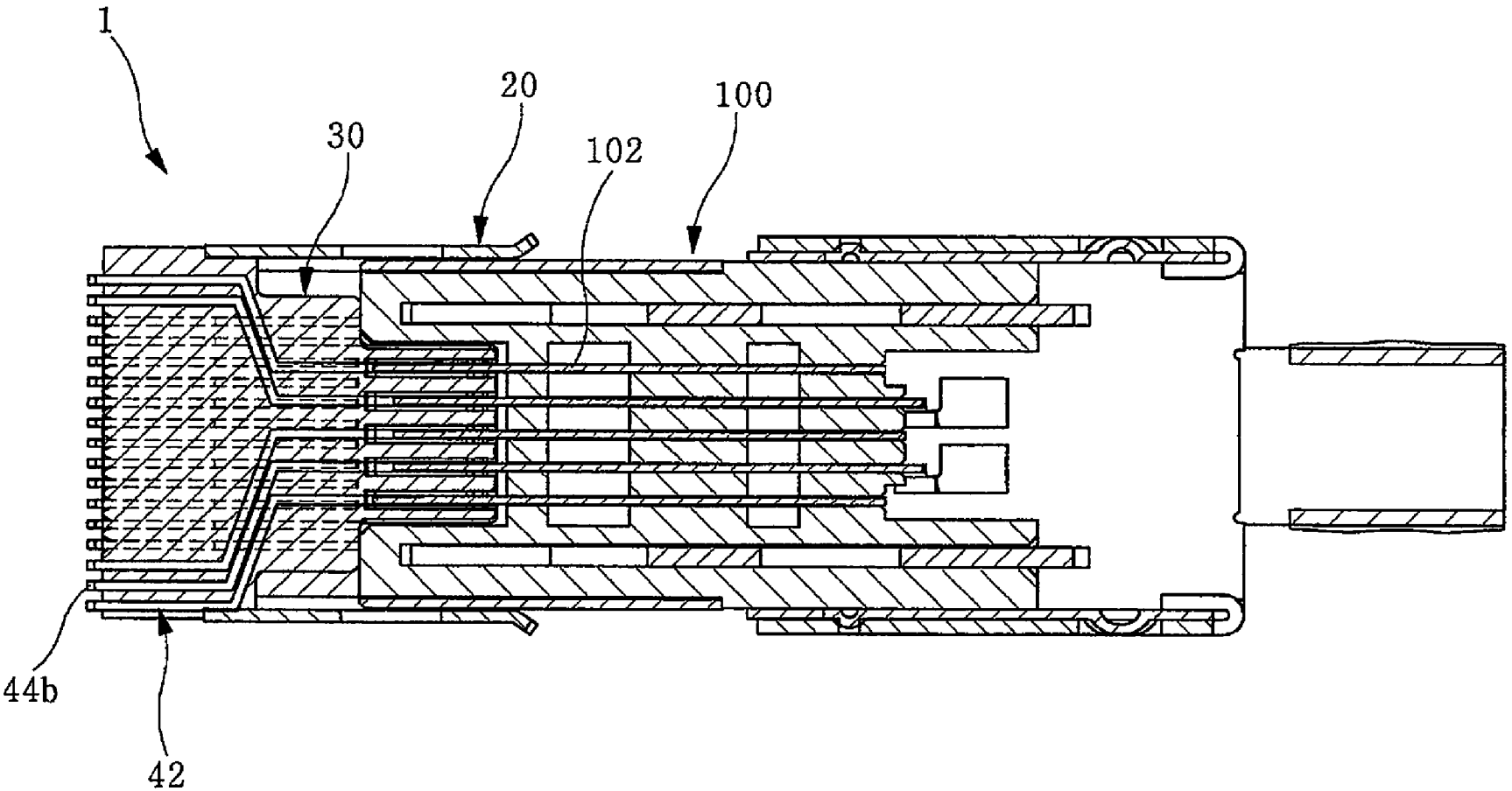
FIG. 4*b* is a plan sectional view of the connecting module in FIG. 1 showing a state wherein a USB memory is coupled to the connecting module.

With the above-described configuration, when it is desired to connect the USB memory 100 to the connecting module 1 of the present invention, as shown in FIGS. 4A-4B, the USB memory 100 is inserted into the guide housing 20, so as to be connected with the first connecting terminal member 42 incorporated in the connecting terminal housing 30. Specifically, the connecting terminals 102 of the USB memory 100 are inserted into the entrance/exit opening of the guide housing 20, so as to be connected with the connecting portions 44*a* of the respective USB memory connecting terminals 44 of the first connecting terminal member 42 incorporated in the upper region of the connecting terminal housing 30. In the connecting terminal housing 30, the second connecting terminal member 46, which is located below the first connecting terminal member 42, is not connected with the connecting terminals 102 of the USB memory 100 because it is shorter than the first connecting terminal member 42 and thus, the front end thereof does not reach the connecting terminals 102 of the USB memory 100.

Once the USB memory 100 is inserted into the guide housing 20 and the connecting terminal housing 30 of the connecting module 1, the USB memory 100 can be fixed to the connecting module 1 as retaining bosses formed at the USB memory 100 are inserted into and caught by the retaining openings 22 of the guide housing 20. Accordingly, if a signal is transmitted from the connecting terminals 102 of the USB memory 100 connected to the connecting portions 44*a*, the signal is sent to the controller of the mobile communication terminal through the coupling portions 44*b*, enabling reception/transmission of a desired data signal.

Figure 5A:
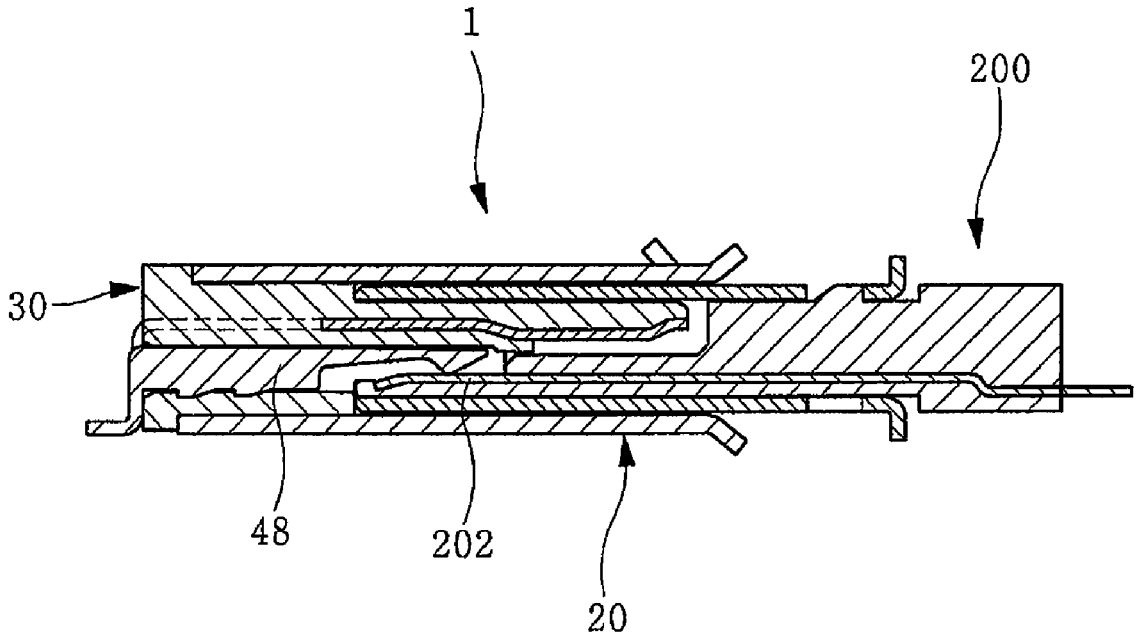
FIG. 5*a* is a side sectional view of the connecting module in FIG. 1 showing an input/output device coupled to the connecting module.
Figure 5B:
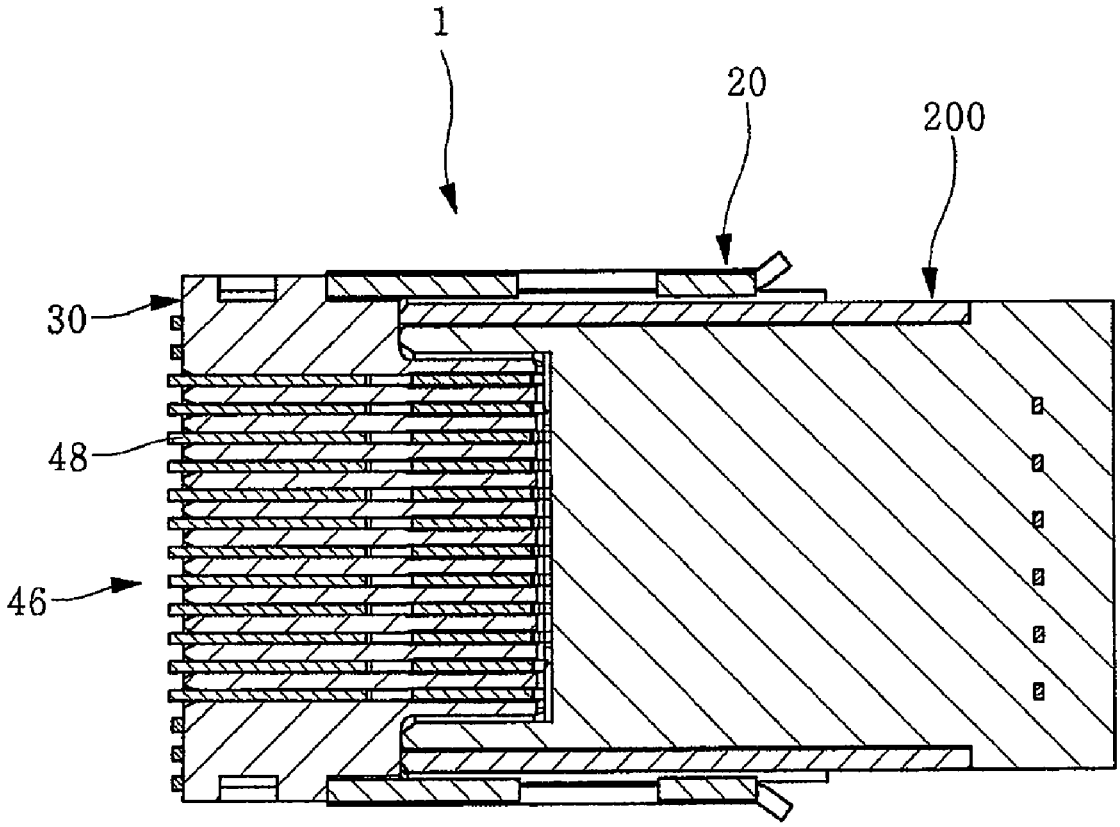
FIG. 5*b* is a plan sectional view of the connecting module in FIG. 1 showing an input/output device coupled to the connecting module.

Then, when it is desired to disconnect the USB memory 100 after completing the use of the USB memory 100 connected to the connecting module 1 and to again connect the input/output device 200 to the connecting module 1 of the present invention, as shown in FIGS. 5A-5B, the input/output device 200 is inserted into the entrance/exit opening of the guide housing 20 such that the connecting terminals 202 thereof are connected to the second connecting terminal member 46 provided in the connecting terminal housing 30.

Specifically, as the input/output device 200 is inserted into the entrance/exit opening of the guide housing 20, the connecting terminals 202 of the input/output device 200 are connected to the second connecting terminal member 46 provided in the connecting terminal housing 30. The second connecting terminal member 46 is located below the first connecting terminal member 42 and is shorter than the first connecting terminal member 42 such that the front end thereof is spaced apart rearward from the front end of the first connecting terminal member 42. Accordingly, the connecting terminal 202 of the input/output device 200 can be connected with only the input/output device connecting terminals 48 of the second connecting terminal member 46, rather than being connected with the USB memory connecting terminals 44.

In this way, a data signal from the mobile communication terminal can be transmitted through the input/output device connecting terminals 48 connected with the connecting terminal 202 of the input/output device 200. As described above, as a result of positioning the connecting terminal members 40 having different lengths at different heights in the connecting module 1, the USB memory 100 or the input/output device 200 can be selectively connected to the connecting module 1 as occasion demands.

As apparent from the above description, the present invention provides the connecting module 1 for a mobile communication terminal, wherein the USB memory 100 and the input/output device 200, connected to the mobile communication terminal for use, can be selectively connected to a single connecting module 1 provided in the mobile communication terminal, rather than requiring different exclusive connecting modules. The connecting module 1 of the present invention can be easily installed in a minimum installation space of the mobile communication terminal, enabling the mobile communication terminal to be much smaller and leaner.

Further, according to the present invention, the guide housing 20 and the connecting terminal housing 30, which constitute a single housing 10 of the connecting module 1, can be easily and simply coupled with each other. As a result, the present invention has the effect of achieving not only rapid housing assembly, but also tight fit between the guide housing 20 and the connecting terminal housing 30. Furthermore, when the connecting terminals 102 of the USB memory 100 or the input/output device 200 are inserted into the guide housing 20, they can be tightly coupled and fixed in the housing 10 as retaining bosses formed at the USB memory 100 or the input/output device 200 are inserted into and caught by the retaining openings 22 of the guide housing 20. This has the effect of preventing the connecting terminals 102 of the input/output device 200 from being easily separated from the connecting module 1.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A connecting module for a mobile communication terminal, comprising:

a housing;

a first connecting terminal member provided in an upper region of the housing for electrically connecting to connecting terminals of a universal serial bus memory and having a downwardly facing connecting portion; and a second connecting terminal member provided in a lower region of the housing for electrically connecting to an input/output device, the second connecting terminal member having a different length than the first connecting terminal member and a downwardly facing connection portion;

wherein the second connecting terminal member is located below the first connecting terminal member and is shorter than the first connecting terminal member such that the downwardly facing connection portion of the second terminal member located at a front end thereof is spaced apart rearward from the downwardly facing connecting portion of the first connecting terminal member and an end of the first connecting terminal that is arranged as a coupling portion in the housing is spaced apart from an end of the second connecting terminal member that is arranged in the housing in a lateral direction with rear ends of the first and second connecting terminal members are located on a same line as each other.

2. The connecting module of claim 1, wherein the first connecting terminal member is molded in the housing.

3. The connecting module of claim 1, wherein the housing includes a guide housing and a connecting terminal housing, the first connecting terminal member and the second connecting terminal member being arranged in the connecting terminal housing.

4. The connecting module of claim 3, wherein the guide housing includes outwardly-spread guide pieces at an outer periphery of an opening that receives the universal serial bus memory and the input/output device.

5. The connecting module of claim 1, wherein the first connecting terminal member includes a plurality of universal serial bus memory connecting terminals, each of the universal serial bus memory connecting terminals including the connecting portion formed at one end thereof that has an open bottom surface for electrically connecting to the connecting terminals of the universal serial bus memory.

6. The connecting module of claim 5, wherein each of the universal serial bus memory connecting terminals includes a coupling portion formed at an end opposite from the connecting portion that extends to an outside of the housing.

7. The connecting module of claim 5, wherein the connecting portion is arranged closer to an opening in the housing that receives the universal serial bus memory and the input/output device than a contact portion of input/output device connecting terminals of the second connecting terminal.

8. The connecting module of claim 1, wherein the second connecting terminal member includes a plurality of input/output device connecting terminals, each of the input/output device connecting terminals being fixed in an insertion opening in the housing.

9. The connecting module of claim 8, wherein each of the input/output device connecting terminals is retained in the insertion opening by a retaining structure.

10. The connecting module of claim 9, wherein the retaining structure includes a retaining protrusion extending from the input/output device connecting terminal and a retaining recess formed in the insertion opening.

11. The connecting module of claim 10, wherein the retaining protrusions are inclined in a direction of insertion of the second connecting terminal into the housing.

* * * * *